US005878546A

United States Patent [19]

Westover

[11] Patent Number: 5,878,546

[45] Date of Patent: Mar. 9, 1999

[54] CONCRETE REINFORCING BAR CONNECTOR

[76] Inventor: Albert R. Westover, E. 511 Wabash, Spokane, Wash. 99207

[21] Appl. No.: 891,021

[22] Filed: Jul. 10, 1997

[51] Int. Cl.[6] ..... E04C 5/16

[52] U.S. Cl. ..... 52/719; 52/721.2; 52/677; 52/686; 52/687; 52/689; 24/329; 24/336; 403/385; 403/388; 403/394

[58] Field of Search ..... 52/719, 721.1, 52/721.2, 677, 686, 687, 689, 649.1; 24/329, 336, 462; 403/385, 388, 394, 400

[56] References Cited

U.S. PATENT DOCUMENTS

| | | | |
|---|---|---|---|
| 4,641,991 | 2/1987 | Yaoita | 52/719 X |
| 4,817,897 | 4/1989 | Kreusel | 403/385 X |
| 5,269,113 | 12/1993 | Dreizler | 52/686 X |

*Primary Examiner*—Lanna Mai
*Assistant Examiner*—W. Glenn Edwards
*Attorney, Agent, or Firm*—Wells, St. John, Roberts, Gregory & Matkin P.S.

[57] ABSTRACT

A concrete reinforcing bar connector is described in which first and second elongated resilient clip members are formed in a substantially semi-circular "C" shaped cross-sectional configuration. The first and second clip members include opposed open ends spaced apart along their respective center axes. Each of the first and second elongated resilient clip members includes a pair of longitudinal edges that are substantially parallel to their associated center axis and are spaced apart from one another to form a reinforcing bar receiving side opening. The longitudinal edges terminate in substantially radially inward projecting flanges. Inwardly projecting yieldable tabs are formed at each end of the first and second clip members. The tabs are angularly inclined toward the respective center axes of the clip members. The tabs are substantially diametrically opposed to the associated reinforcing bar receiving side openings. A pivot connection joins the first and second clip members for relative pivotal movement about an axis normal to the center axes. The pivot connection is located in substantially diametric opposition to the reinforcing bar receiving side openings.

12 Claims, 5 Drawing Sheets

CONCRETE REINFORCING BAR CONNECTOR

TECHINICAL FIELD

The present invention relates to connection of concrete reinforcing bars.

BACKGROUND OF THE INVENTION

Reinforcing bars are used to lend added strength to concrete structures. The bars are typically arranged in desired spatial relation before forms are set, then concrete is poured into the forms over the previously arranged reinforcing bars. It is a common practice to have the concrete reinforcing bars cross one another in a grid pattern to provide additional reinforcement within the concrete structure in multiple directions. The reinforcing bars must somehow be suspended within the concrete forms in such a manner that the rods will stay in selected positions while concrete is being poured.

The problem of securing patterns of intersecting reinforcing bars has been addressed in the past. The solution offered is the current typical practice to use wire ties, wrapped manually about the bars at their intersections in order to hold the bars in place prior to pouring concrete. While wire ties function adequately, the manual tying process is labor intensive and expensive. Thus a problem remains; how to adequately connect concrete reinforcing bars in a fast and efficient manner.

The above problem has been answered to a degree by the development of plastic clips designed to be snapped over intersecting concrete rods. A U.S. Pat. No. (5,371,991) to Bechtel discloses a "Rebar Clamp Assembly" in which plastic clips are provided to secure ersecting reinforcing rods together.

The Bechtel connectors make use of "C" shaped clips, provided in joined pairs. The clips are either formed integrally or are pivotably connected together with swivels. In either instance, the open "mouths" of the clips in each pair are angularly spaced from one another by an angle of 90°. The internal surfaces of the plastic clip members are smooth and axially uninterrupted.

The angular relation of the "mouths" of the Bechtel clips creates a problem with the structural integrity of the clips themselves. The swivel pins that pivotably join the clips are situated such that one side of each clip is reinforced by the pin, and the remaining side is free to flex. Thus the free sides of the clips are primarily depended upon to flex open to receive reinforcing bars, and can be deformed or break in the process.

The smooth internal bores of the Bechtel clips allow the clips to slide axially along the rods, or to allow the rods to slide along the clips. This can be a serious disadvantage, especially when the clips are to be depended upon to hold a rod in place. By way of example, many reinforced wall constructions require both horizontal and vertical reinforcing rods. The Bechtel clip, attached between a horizontal rod and a vertical rod, may not afford sufficient gripping force to preven the vertical rod from sliding downwardly. Additional support become necessary to hold the vertical rod in place especially as concrete is poured. If sufficient gripping force is provided by spring tension within the clips to hold a rod vertically, then the clips themselves become very difficult to install on the bars.

The present clip arrangement provides a solution to the above problems by enabling uniform gripping of reinforcing rods, with opposed legs of the present clip members flexing substantially equally, and by engaging the rods in such a manner that axial movement of the engaged rods is inhibited. The above and other objects and advantages of the present invention will become further evident from the following detailed description. to support the rods.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Before proceeding with a detailed description of preferred forms of the present connector, a brief account will be given regarding several forms of standard bar configurations used for concrete reinforcement. The bars are typically formed of hot rolled steel and are substantially circular in cross section with external, integral ribs projecting outwardly of a circular solid core. The bars are available in a variety of diameters and lengths.

FIGS. 1–4 show segments of several standard concrete reinforcing bar configurations. It is noted that all the illustrated forms include diametrically opposed longitudinal ribs R that extend along the bar length and lateral arcuate rib segments S that extend about the bar, joining the longitudinal ribs. The ribs are used to bond the bars with concrete in formed structures.

Figure 1:
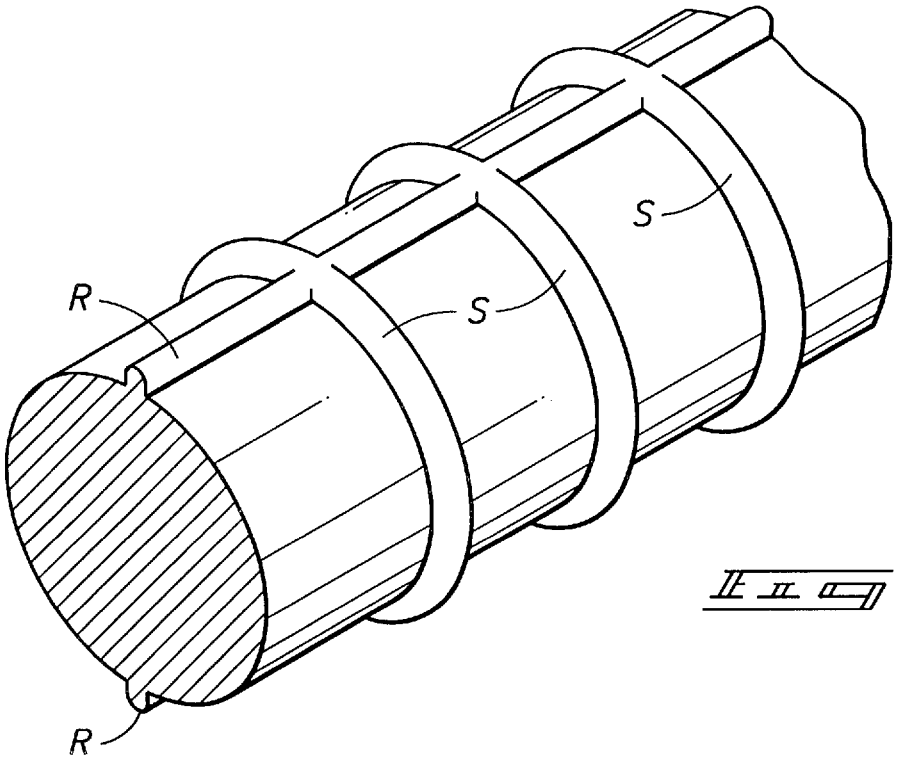
FIGS. 1–4 are examples of standard reinforcing steel bar shapes.
Figure 2:
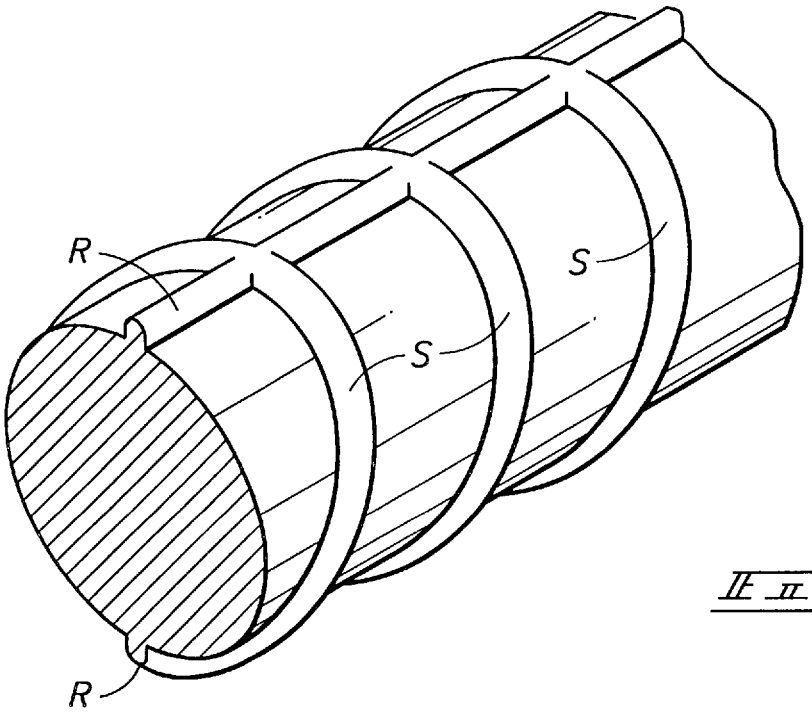
Figure 3:
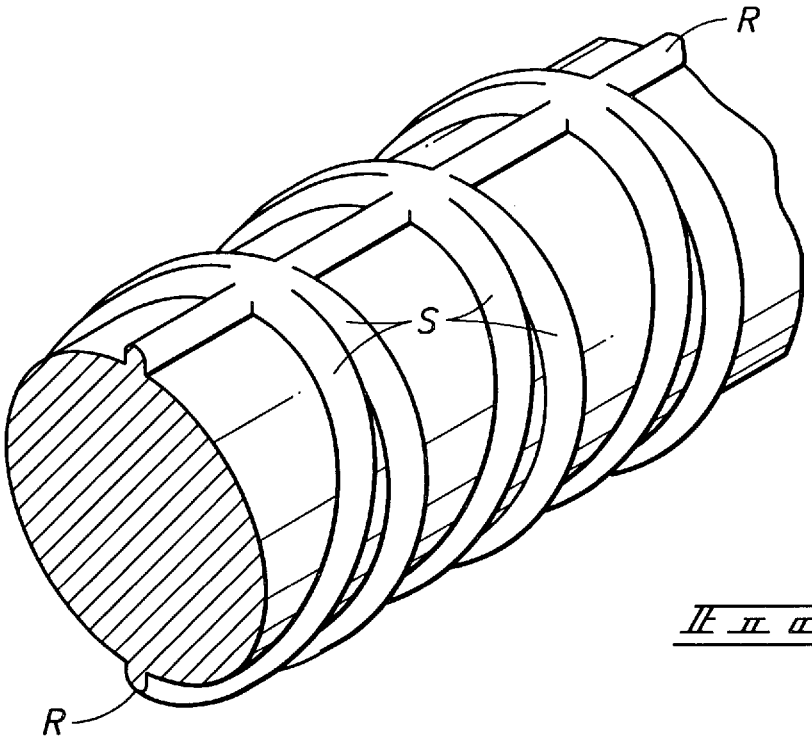
Figure 4:
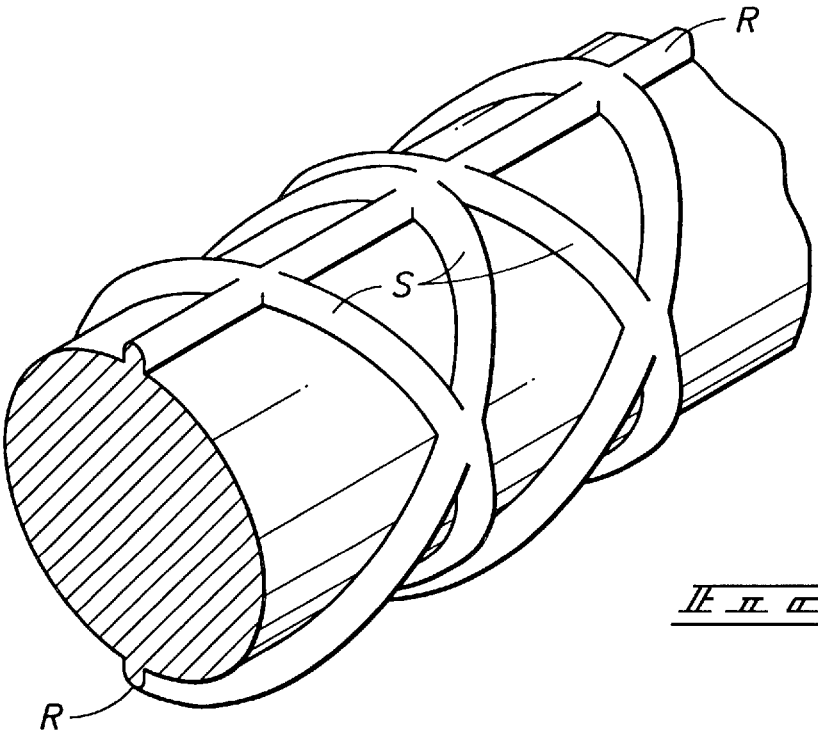

In FIG. 1, the rib segments S are laterally oriented (at substantially right angles to the longitudinal ribs R). In FIG. 2, the lateral rib segments S are inclined angularly, similarly to screw threads. In FIG. 3, lateral rib segments S are substantially "X" shaped. In FIG. 4, the rib segments S are substantially "V" shaped.

Standard reinforcing rod are designated by ASTM (American Society for Testing and Materials) grades, ranging from 3 to 18. A grade 3 rod includes a nominal diameter of 0.375 inches; a grade 18 rod includes a nominal diameter of 2.257 inches. In all known standard reinforcing rod forms, the longitudinal ribs R, and lateral rib segments S project outwardly of the bar by radial distances which vary according to the size of the rod, from approximately 0.03 inches (at grade 3) to 0.125 inches (at grade 18). The rib segments are integral with the rod and are typically rounded, tangentially joining the solid cylindrical rod core.

The present connector is provided to enable selective joining of one concrete reinforcing rod to another, and to hold the joined rods in a select spatial relation. Provisions are made within the present connector to perform this function, as will be understood from the following description.

A first preferred form of the present concrete reinforcing bar connector is designated in the drawings by the reference numeral 10. The bar connector 10 is provided to interconnect two sections of concrete reinforcing bars R in a particular desired spatial relationship, and to hold the bars in the selected relation.

The connector 10 includes first and second elongated resilient clip members 12, 14. It is preferred that the clip members be formed of a spring steel or other resilient metal. Alternatively, the clip members could be formed of an appropriate resilient plastic material.

Figure 5:
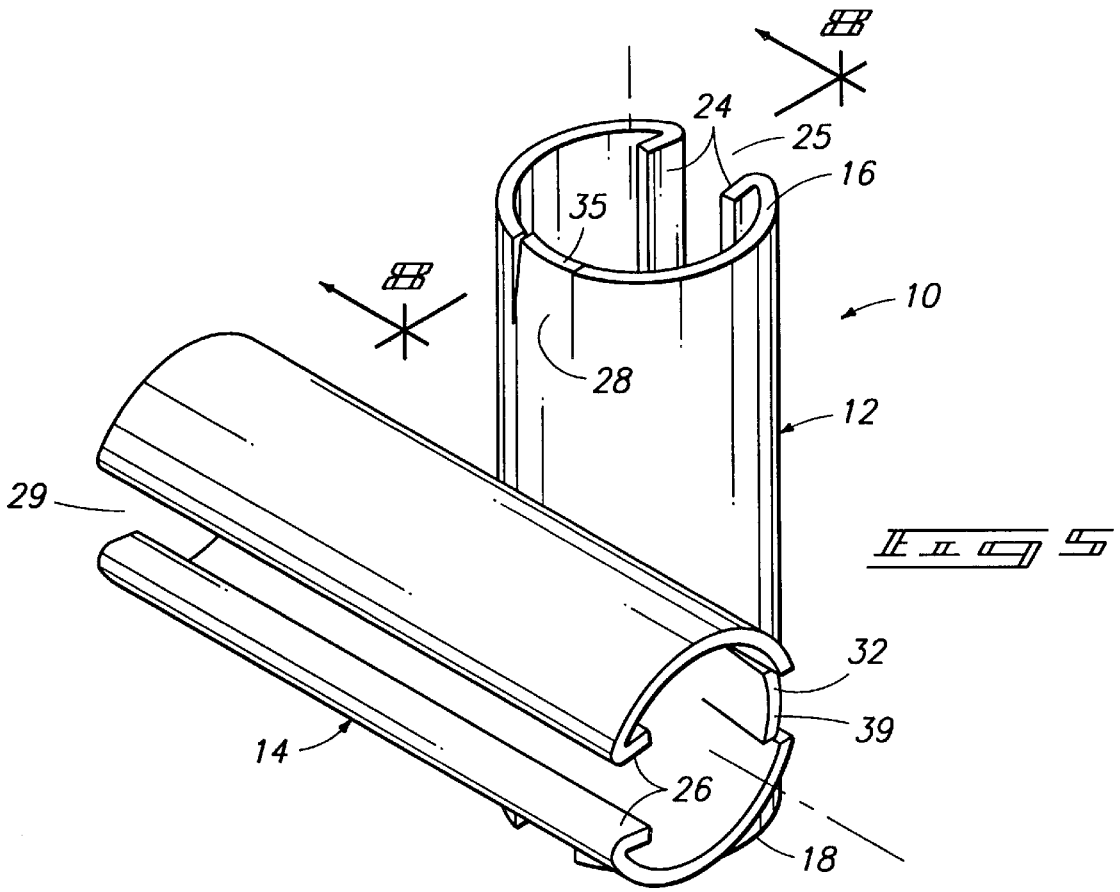
FIG. 5 is a perspective view of a first preferred form of the present connector.

Each preferred clip member 12, 14 is formed in a substantially semi-circular "C" shaped cross-sectional configuration that extends along a respective longitudinal center axis Y, X (FIG. 5). The first clip member 12 extends along axis Y between opposed open ends 16, 18. Second clip member 14 extends along axis Y between similarly opposed open ends 20, 22. The length dimensions of the clip members, between respective open ends may vary according to the bar grade being used, but should be sufficient to overlap at least two successive lateral bar rib segments S.

It is pointed out that the clip members 12, 14 are preferably substantially identical. This provision reduces manufacturing costs and enables interchangeable use of the clip members. Interchangeability in use allows the connector to be clipped onto two rods with either one of the two clip members 12 or 14 engaging either one of the two rods. Thus the installer need not take time to study the arrangement of the clips to determine which rod is to receive which clip member.

Diameters of the clip members may be identical as shown, or may be altered according to the grade of reinforcing bars being used. Also, there is inherent capability in the resilient material used to enable use of a single diameter size for the clip members to be used with, say two successive different bar gauges. For example, a connector intended for primary use with a grade 8 of bar could also be used with a grade 9 bar and, possibly grade 7.

Each of the first and second elongated resilient clip members 12, 14 includes a pair of longitudinal edges that are substantially parallel to the associated center axis and spaced apart from one another. The spaced edges form first and second reinforcing bar receiving side openings 25, 29 extending between and joining the open ends of the respective clip members. The openings are smaller than the effective diameters of the reinforcing bar size, but will spring open and close over the bar simply by either forcing the clip members over the bars or by forcing the bars into the clips.

Figure 8:
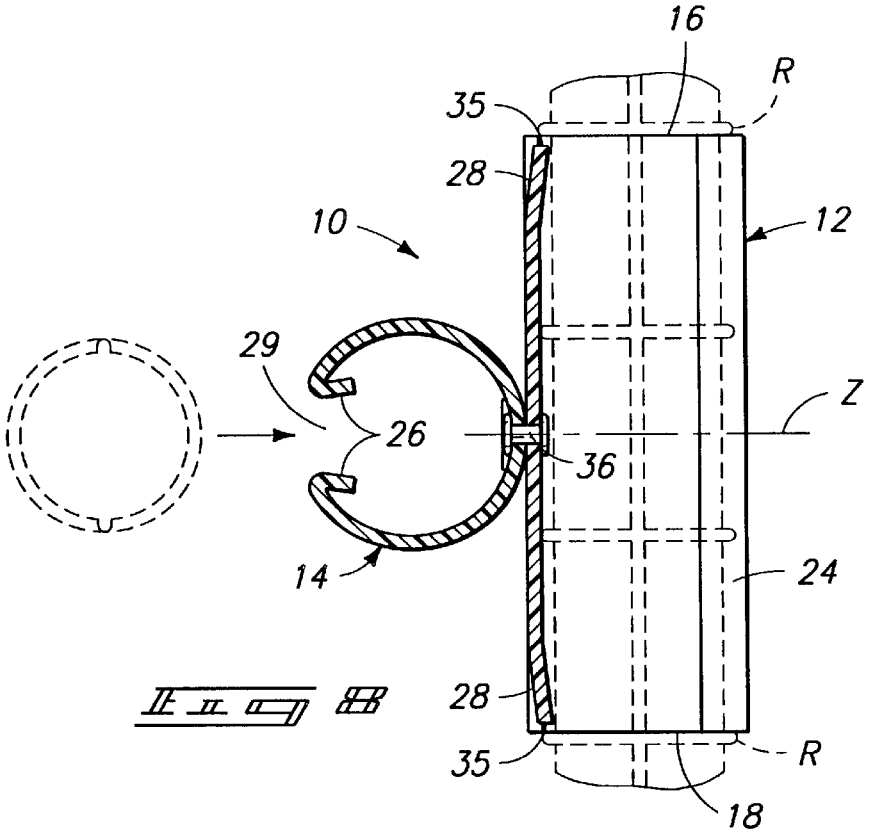
FIG. 8 is an enlarged sectional view taken along line 8–8 in FIG. 6 with the reinforcing rods shown by dotted lines.

The longitudinal edges terminate in substantially radially inward projecting flanges 24, 26 that extend along the respective clip members 12, 14 between the opposed open ends. The end edges of the flanges 24, 26 are provided to engage and longitudinally secure the clip members to reinforcing rods, and to bias the rods against tabs 28, 32 (described below). The flange ends are positioned to abut the lateral rib segments S on an engaged reinforcing rod R (FIG. 8). This helps maintain the clip members in longitudinal position along the engaged reinforcing rods by abutting against the reinforcing rod rib segments adjacent either clip member end. To this end, it is preferred that the flanges project inwardly a radial distance of approximately 1/16 inch toward the respective center axes X, Y.

Inwardly projecting pairs of yieldable tabs 28, 32 are also formed in each end of the first and second clip members. More specifically, tabs 28 are provided on respective ends 16, 18 of the first clip member 12. Second clip member 14 includes tabs 32 at respective opposed open ends 20, 22. Both tabs 28, and 32 are angularly inclined toward the respective center axes Y, X. These tabs, like the flanges described above, include axially outward facing abutment surfaces 35, 39 provided specifically to secure the respective clip members longitudinally against the arcuate lateral rib segments S or the longitudinal ribs R on the reinforcing rods. The tabs 28, 32 also preferably project radial distances of approximately 1/16 inch toward the respective center axes X, Y.

Figure 6:
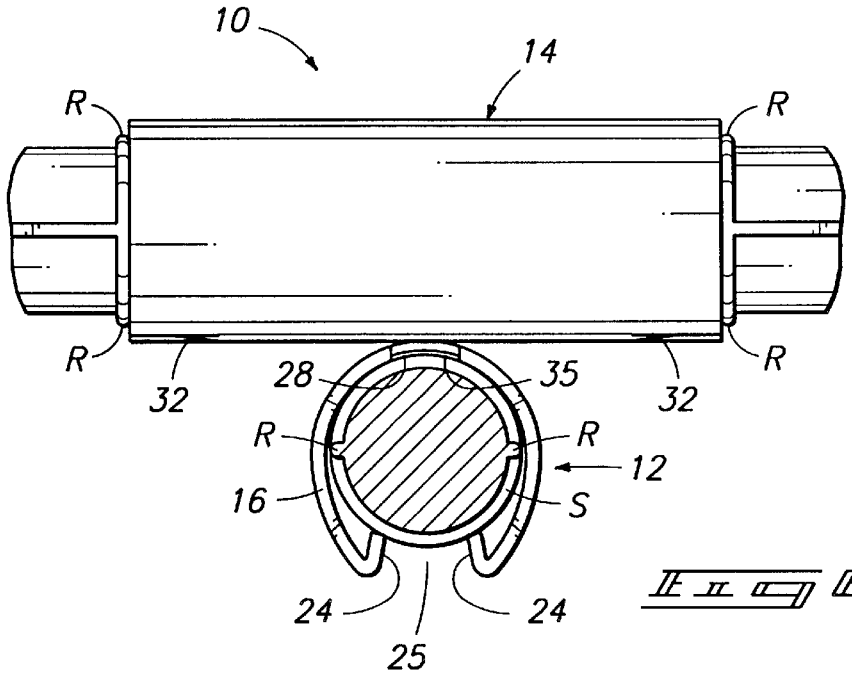
FIG. 6 is top plan view of the preferred connector mounted to reinforcing steel bars.

The preferred tabs 28, and 32 are substantially diametrically opposed to the associated flanges 24, 26 and the openings 25, 29. The spring action of the clip members, urging the flanges 24, 26 against the engaged rods thus function to urge the rods against the tabs 28, 32 (see FIGS. 6 and 8). The tabs 28, 32, being positioned to engage the reinforcing rod ribs segments R or S, will thus prevent the rods from moving any significant distance longitudinally relative to the clip members.

Figure 7:
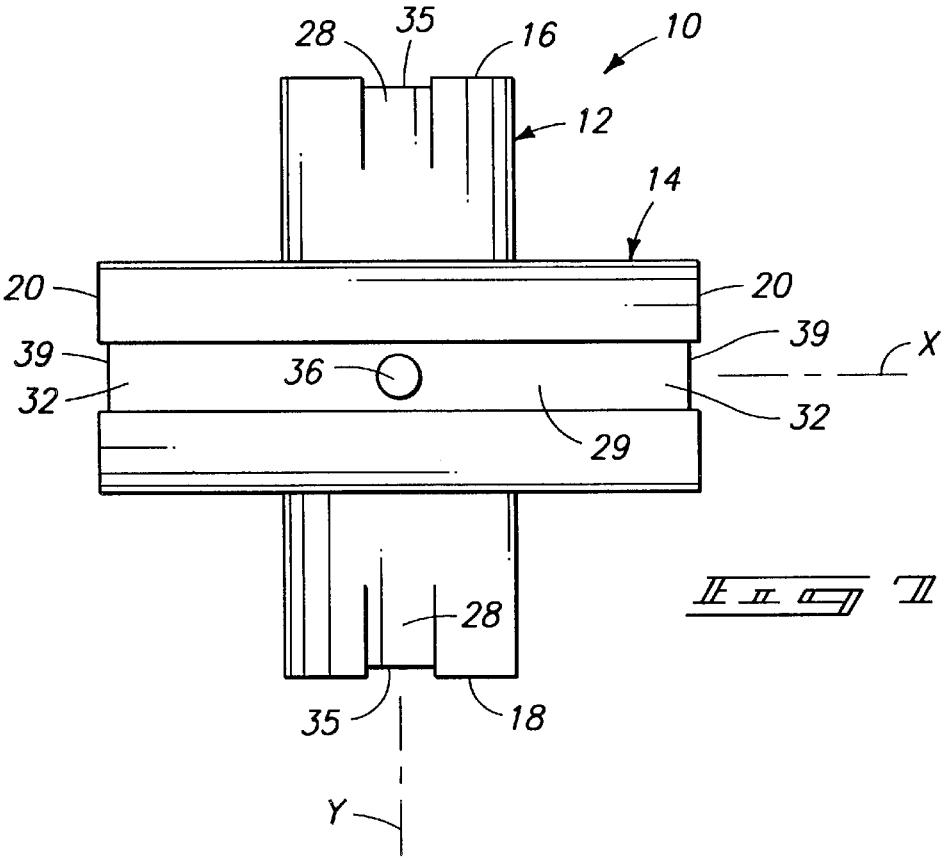
FIG. 7 is a frontal view of the connector.
Figure 9:
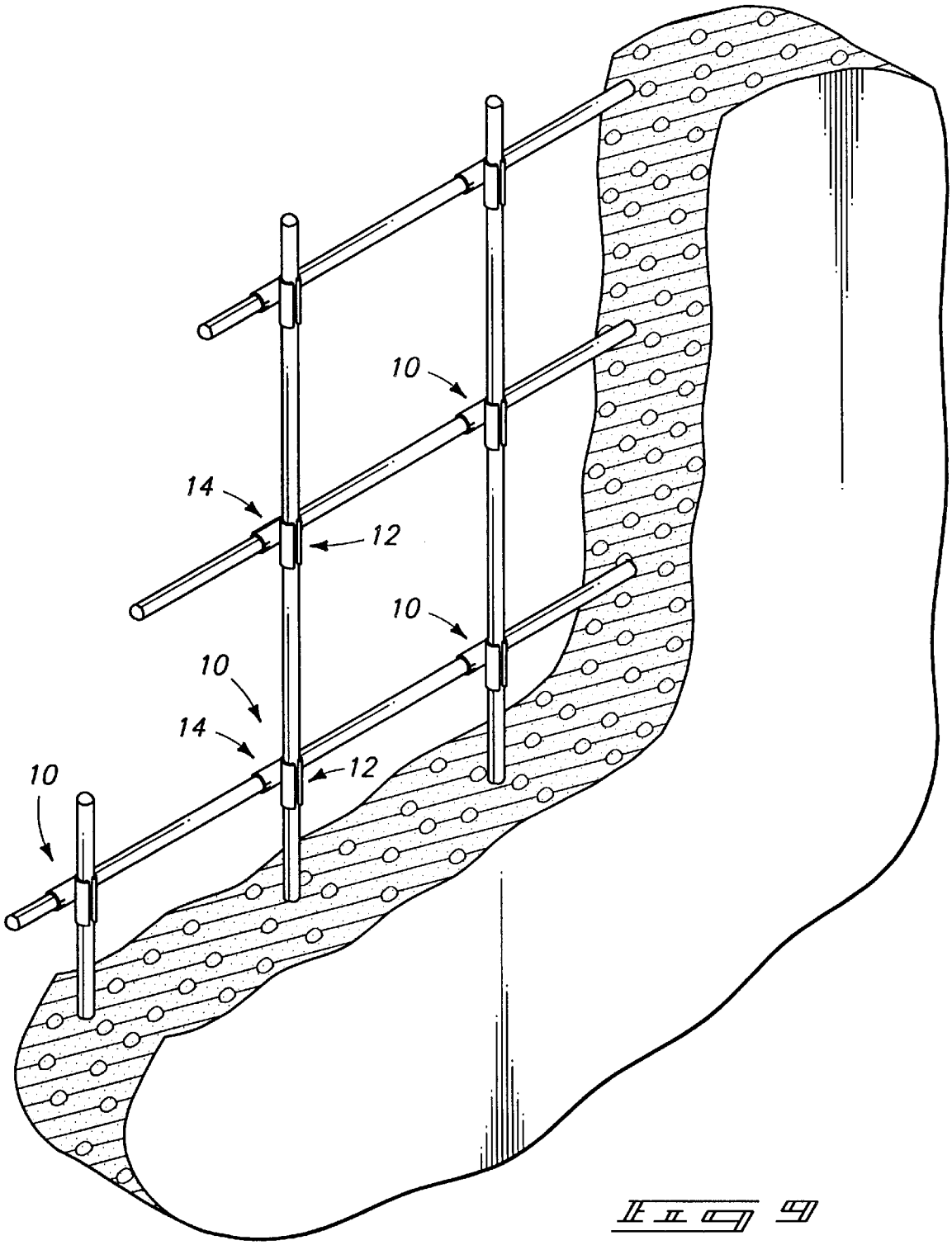
FIG. 9 is a fragmented perspective view of a concrete form with reinforcing steel positioned and joined by the preferred connectors.

In a preferred form of the present connector 10, a pivot connection 36 (FIGS. 7, 8) is provided, joining the first and second clip members for relative pivotal movement about an axis Z (FIG. 8) normal to the center axes X and Y. The pivot 36 may be provided by means of a rivet (as shown) or another appropriate device which will retain the two clip members together, and which will enable relative pivotal movement. The pivot connection enables the connector 10 to be used with reinforcing rods that are not perpendicular to one another. In fact, the clip members may be pivoted to orientations where the respective axes X and Y are parallel, if so desired. However it is anticipated that most connections will be made with rods that are perpendicular as shown in FIG. 9.

It is also noted that the preferred pivot connection is located in substantially diametric opposition to the reinforcing bar receiving side openings 25, 29. This location for the pivot connection is most preferable, to minimize or eliminate shearing forces that would otherwise occur between the pivot and clip members when the clip members are attached to reinforcing rods. The pivot location is also preferred to facilitate uniform flexure of the clip members, equalizing stresses on both sides of the openings 25, 29 when the clip members are attached to reinforcing rods.

From the above technical description, operation of the present connector 10 may now be easily understood. Such description will be given assuming a pair of reinforcing rods are to be connected, with one rod being horizontal and another vertical. Of course the connector 10 may be used as well to interconnect rods having other angular relationships, given the capability of the clip members to be pivoted about the axis Z of pivot 36.

An assumption will also be made, simply for purposes of example, that the vertical rod is in place, and that the horizontal rod is to be positioned at a particular location along the vertical rod. This is a common practice when reinforcing rods are being placed within a form for a wall or other upright structure (FIG. 9).

The first step, according to the above exemplary situation, is to secure one of the clip members (say first member 12) to the vertical rod, with the pivot axis Z at the desired future location of the horizontal rod. The clip member is attached simply by forcing the clip member directly onto the vertical rod. This is done with the side opening 25 of the clip member 12 aligned with the vertical rod. The clip member is simply pressed firmly against the rod with sufficient force to cam the sides of the clip member apart. The sides of the clip member will automatically spring back as the rod is received within the central open part of the member. As this happens, the rod is engaged by the edges of the flanges 24 and is pushed against the tabs 28 on the opposite side. The tabs are positioned to abut any adjacent longitudinal ribs R or lateral arcuate rib segments S that extend about the bar. The opposed inclined tabs prevent longitudinal movement of the connector along the engaged rod, and hold the connector firmly in position.

Next, the horizontal rod is placed (FIG. 8). This step is accomplished in the same manner described above except now the second clip member 14 (pivoted to the horizontal) is used to secure the horizontal rod in the position already determined by previous placement of the connector on the vertical rod. The horizontal rod is simply lifted to the location of the connector and is pressed into the second clip member. The flanges 26 and tabs 32 will function to hold the horizontal rod firmly in position against any significant lateral movement with respect to the vertical rod. At the same time the first clip member, being secured along the vertical rod, will prevent the horizontal rod from sliding downwardly under the weight of the horizontal rod. The two rods are thus secured at the point of intersection and neither will move significantly along their respective longitudinal axes.

The above steps are repeated at any selected location where reinforcing rods are to intersect (see FIG. 9). The connectors 10 will secure the rods at the selected intersections without requiring wire ties or other forms of support. When all the desired rods are positioned and secured with connectors 10, concrete may be poured with assurance that the rods will not be jostled and moved by the force of the flowing concrete.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A concrete reinforcing bar connector, comprising:

first and second elongated resilient clip members, each formed in a substantially "C" shaped cross-sectional configuration, about a longitudinal center axis;

each clip member including opposed open ends spaced apart along the clip member center axis;

each clip member defining a longitudinal reinforcing bar receiving side opening joining the opposed open ends;

an inwardly projecting tab on each of the first and second clip members, projecting inwardly toward the respective center axis; and a pivot connection joining the first and second clip members for relative pivotal movement about a pivot axis normal to the center axes such that each of the clip members may be selectively pivoted relative to one another about the pivot axis.

2. The concrete reinforcing bar connector of claim 1, further comprising:

opposed longitudinal edges on each of the clip members, defining the respective longitudinal reinforcing bar receiving side openings; and an inwardly projecting flange formed along at least one of the longitudinal edges.

3. The concrete reinforcing bar connector of claim 1, further comprising:

opposed longitudinal edges on each of the clip members, defining the respective longitudinal reinforcing bar receiving side openings;

an inwardly projecting flange formed along each one of the longitudinal edges; and wherein the flanges project inwardly a radial distance of approximately 1/16 inch toward the center axis.

4. The concrete reinforcing bar connector of claim 1, further comprising:

opposed longitudinal edges on each of the clip members, defining the respective longitudinal reinforcing bar receiving side openings;

an inwardly projecting flange formed along each one of the longitudinal edges; and wherein the tabs and the flanges each project inwardly a radial distance of approximately 1/16 inch toward the center axis.

5. The concrete reinforcing bar connector of claim 1, wherein the pivot connection is comprised of a rivet pivotably joining the first and second clip members.

6. The concrete reinforcing bar connector of claim 1, wherein the pivot connection is comprised of a rivet pivotably joining the first and second clip members at locations thereon substantially diametrically opposite the respective reinforcing bar receiving side openings.

7. The concrete reinforcing bar connector of claim 1, wherein the pivot connection joins the first and second clip members at locations thereon substantially diametrically opposite the respective reinforcing bar receiving side openings.

8. The concrete reinforcing bar connector of claim 1, wherein the pivot connection is comprised of a rivet pivotably joining the first and second clip members at locations thereon in substantial diametric opposition to the longitudinal reinforcing bar receiving side openings; and wherein the tabs are also in substantial diametric opposition to the longitudinal reinforcing bar receiving openings.

9. The concrete reinforcing bar connector of claim 1, wherein the open ends are transverse to the respective center axes and wherein the tabs include radially inwardly disposed abutment surfaces facing axially outward of the respective clip members.

10. The concrete reinforcing bar connector of claim 1, wherein the open ends are transverse to the respective center axes and wherein the tabs are angularly inclined toward the respective center axes from the respective first and second clip members and include radially inwardly disposed abutment surfaces facing axially outward of the respective clip members.

11. The concrete reinforcing bar connector of claim 1, wherein the open ends are transverse to the respective center axes and wherein the tabs are angularly inclined toward the respective center axes from the respective first and second clip members.

12. A concrete reinforcing bar connector, comprising:

first and second elongated resilient clip members, each formed in a substantially "C" shaped cross-sectional configuration, about a longitudinal center axis;

wherein the first and second elongated resilient clip members include opposed open ends spaced apart along the respective center axes;

wherein each of the first and second elongated resilient clip members includes a pair of longitudinal edges that are substantially parallel to the associated center axis and spaced apart from one another to form a reinforcing bar receiving side opening extending between and joining the open ends of the clip member;

wherein the longitudinal edges terminate in substantially radially inward projecting flanges that extend along the clip members between the opposed open ends;

inwardly projecting tabs formed in the clip members and projecting toward the respective center axes;

wherein the tabs of the respective first and second clip members are substantially diametrically opposed to the associated reinforcing bar receiving side opening;

a pivot connection joining the first and second clip members for relative pivotal movement about a pivot axis normal to the center axes such that each of the clip members may be selectively pivoted relative to one another about the pivot axis; and wherein the pivot connection is located in substantially diametric opposition to the reinforcing bar receiving side openings.

* * * * *

UNITED STATES PATENT AND TRADEMARK OFFICE

CERTIFICATE OF CORRECTION

PATENT NO. : 5,878,546

DATED : March 9, 1999

INVENTOR(S) : Albert R. Westover

It is certified that error appears in the above-identified patent and that said Letters Patent is hereby corrected as shown below:

Col. 1, l. 34: Replace "ersecting" with --intersecting--.

Col. 1, l. 60: Replace "preven" with --prevent--.

Col. 1, l. 61: Replace "become" with --becomes--.

Signed and Sealed this

Third Day of August, 1999

*Attest:*

*Attesting Officer*

Q. TODD DICKINSON

*Acting Commissioner of Patents and Trademarks*